US011583042B2

(12) United States Patent
Lachat et al.

(10) Patent No.: US 11,583,042 B2
(45) Date of Patent: Feb. 21, 2023

(54) BRACELET WITH ADJUSTABLE LINK FOR A WATCH OR A PIECE OF JEWELLERY

(71) Applicant: The Swatch Group Research and Development Ltd, Marin (CH)

(72) Inventors: Sophie Lachat, Bienne (CH); Paulo Bravo, Marin-Epagnier (CH)

(73) Assignee: The Swatch Group Research and Development Ltd, Marin (CH)

( * ) Notice: Subject to any disclaimer, the term of this patent is extended or adjusted under 35 U.S.C. 154(b) by 290 days.

(21) Appl. No.: 16/927,523

(22) Filed: Jul. 13, 2020

(65) Prior Publication Data

US 2021/0076788 A1 Mar. 18, 2021

(30) Foreign Application Priority Data

Sep. 17, 2019 (EP) ..... EP19197697

(51) Int. Cl.
*A44C 5/02* (2006.01)

(52) U.S. Cl.
CPC ..... *A44C 5/02* (2013.01)

(58) Field of Classification Search
CPC ..... A44C 5/02; A44C 5/08; A44C 5/246
See application file for complete search history.

(56) References Cited

U.S. PATENT DOCUMENTS 922,451 A * 5/1909 Bliss ..... A44C 5/08 59/79.3
926,089 A * 6/1909 Bagnall ..... A44C 5/08 59/79.3
2,573,415 A * 10/1951 Ebert ..... A44C 5/08 59/79.3
2,690,049 A * 9/1954 Pinson ..... A44C 5/08 59/79.1
5,787,554 A * 8/1998 Hashimoto ..... A44C 5/2052 24/71 J
7,926,150 B2 * 4/2011 Robert ..... A44C 5/246 24/70 J (Continued)

FOREIGN PATENT DOCUMENTS

EP 0 737 427 B1 3/2001
EP 2 888 967 A1 7/2015
EP 3 155 921 B1 5/2018

OTHER PUBLICATIONS

European Search Report for EP 19 19 7697 dated Feb. 19, 2020.

*Primary Examiner* — Jack W Lavinder
(74) *Attorney, Agent, or Firm* — Sughrue Mion, PLLC

(57) ABSTRACT

An adjustable link (10) for watch or jewellery bracelet (100), including a first element (1) and second element (2) assembled by spacing adjustment means (30) according to discrete positions, the first element (1) including a transverse chamber (15) enclosing two jaws (12A; 12B) returned one towards the other by springs (13A; 13B) and including notches (120A; 120B) for immobilising in various longitudinal positions (D) a stop element (5) integral with the second structural element (2), these jaws (12A; 12B) being disengageable by transverse push-buttons (3A; 3B), each including a protrusion or recess (31) continuously engaging with an complementary protrusion or recess (131) of the first structural element (1) for protecting the spacing adjustment means (30) against the insertion of foreign bodies, and for hiding same from the view of the user.

12 Claims, 10 Drawing Sheets

(56) References Cited

U.S. PATENT DOCUMENTS

| | | | | |
|---|---|---|---|---|
| 8,910,348 | B2 * | 12/2014 | Schenk | A44C 5/246 63/3.2 |
| 9,003,611 | B2 * | 4/2015 | Catanese | A44C 5/246 63/3.2 |
| 9,198,485 | B2 * | 12/2015 | Kaltenrieder | A44C 5/246 |

* cited by examiner

BRACELET WITH ADJUSTABLE LINK FOR A WATCH OR A PIECE OF JEWELLERY

CROSS REFERENCE TO RELATED APPLICATIONS

This application is Non-Provisional Application, claiming priority based on European Patent Application No. 19197697.6 filed Sep. 17, 2019.

FIELD OF THE INVENTION

The invention relates to an adjustable link for a watch or jewellery bracelet, comprising at least one first structural element and one second structural element arranged for being assembled with one another in a longitudinal direction by means of a spacing adjustment mechanism, and each comprising, at one of the ends thereof opposite the adjustment mechanism in a longitudinal direction, attachment means arranged for engaging with complementary attachment means of a watch, or a piece of jewellery, or another link, or a clasp.

The invention again relates to a watch or jewellery bracelet comprising at least such an adjustable link.

The invention again relates to a watch comprising such a bracelet

The invention again relates to a piece of jewellery comprising such a bracelet.

The invention relates to the field of watch or jewellery bracelets.

BACKGROUND OF THE INVENTION

Generally, a watch or jewellery bracelet is adjustable at predetermined positions, which enable precise repositioning, and that the user may adjust by engaging a finger with one hole of a plurality of holes, or by hooking a pin on a rack, or similar. Other closures, of continuous holding in position by friction type, do not offer a possibility of precise repositioning.

Document CH 699067 describes a device for fine adjustment of the length of a bracelet, that is integrated into the cover of a clasp, and comprises an indexing device in two predefined positions, and that includes ball spring push-buttons integral with a transverse bar linked at one end of the bracelet and provided for engaging with the holes provided in the cover of the clasp. Such a device acts transversally, in general requires the use of a tool for making the adjustment, and remains visible.

Document EP 2484244 describes an adjustable link for a bracelet, comprising at least one first half link and at least one second half link arranged for being assembled movable in relation to one another in a longitudinal direction of the bracelet, using an adjustable mechanism with no particular tools, where the adjustment mechanism remains concealed. Such a device allows a gap to appear at the connecting member between the half links, which impairs the appearance of the bracelet. In addition, the link may become incorrectly adjusted during an impact, nothing providing a reliable locking of the adjustment.

Document U.S. Pat. No. 5,787,554 describes a bracelet length adjustment device, comprising a housing that is provided for accommodating the necessary elements and for being connected to the bracelet strand at one end thereof. A slide plate is slidably mounted in the housing so as to be moved in a longitudinal direction of the strand, and connected to the other end of the strand, and a push plate is laterally sliding in the housing space of the housing. Ratchet teeth are formed on the slide plate. A locking projection is formed on the push plate, and a spring is provided for pushing the push plate for engaging the projection with one of the ratchet teeth at a position selected from a plurality of positions depending on the ratchet teeth.

Few bracelet length adjustment mechanisms make it possible to overcome the presence of a clasp. The clasp remains a costly, heavy, mechanism, which may impair the aesthetics of a bracelet, or even prove awkward to manipulate.

SUMMARY OF THE INVENTION

The invention proposes to produce a bracelet that can be length adjusted, in a very easy manner for the user, using a hidden adjustment mechanism that does not impair the aesthetics of the bracelet, and the possibility of overcoming the presence of a clasp thanks to the rapid manoeuvre of a few adjustable links, for enabling the putting on of a bracelet held closed in a loop, then an extremely easy adjustment on the wrist of the user.

To this end, the invention relates to an adjustable link for a watch or jewellery bracelet, comprising at least one first structural element and one second structural element arranged for being assembled with one another in a longitudinal direction by means of a spacing adjustment mechanism, and each comprising, at one of the ends thereof opposite the adjustment mechanism in a longitudinal direction, attachment means arranged for engaging with complementary attachment means of a watch, or a piece of jewellery, a another link, or a clasp.

The invention again relates to a watch or jewellery bracelet comprising at least such an adjustable link.

The invention again relates to a watch comprising such a bracelet

The invention again relates to a piece of jewellery comprising such a bracelet.

SUMMARY DESCRIPTION OF THE DRAWINGS

Other features and advantages of the invention will become apparent upon reading the following description, with reference to the appended drawings, where:

FIG. 1 shows, schematically, in exploded perspective, a first variant of adjustable link according to the invention, comprising a first component enclosing a chamber where are moveable, transversally, jaws suitable for clasping, in various discrete longitudinal positions, a stop element which is integral with a control rod fastened to a second structural element forming the other half of the adjustable link; lateral push-buttons are arranged for transversally manoeuvring the jaws for releasing the stop element, and changing the relative position thereof in relation to the first element due a longitudinal movement imprinted with the second element in relation to the first element, or vice versa, followed by a release of the push-buttons for allowing the return in engagement of the jaws with the stop element, in a new position of elongation between the first element and the second element;

Figure 1:
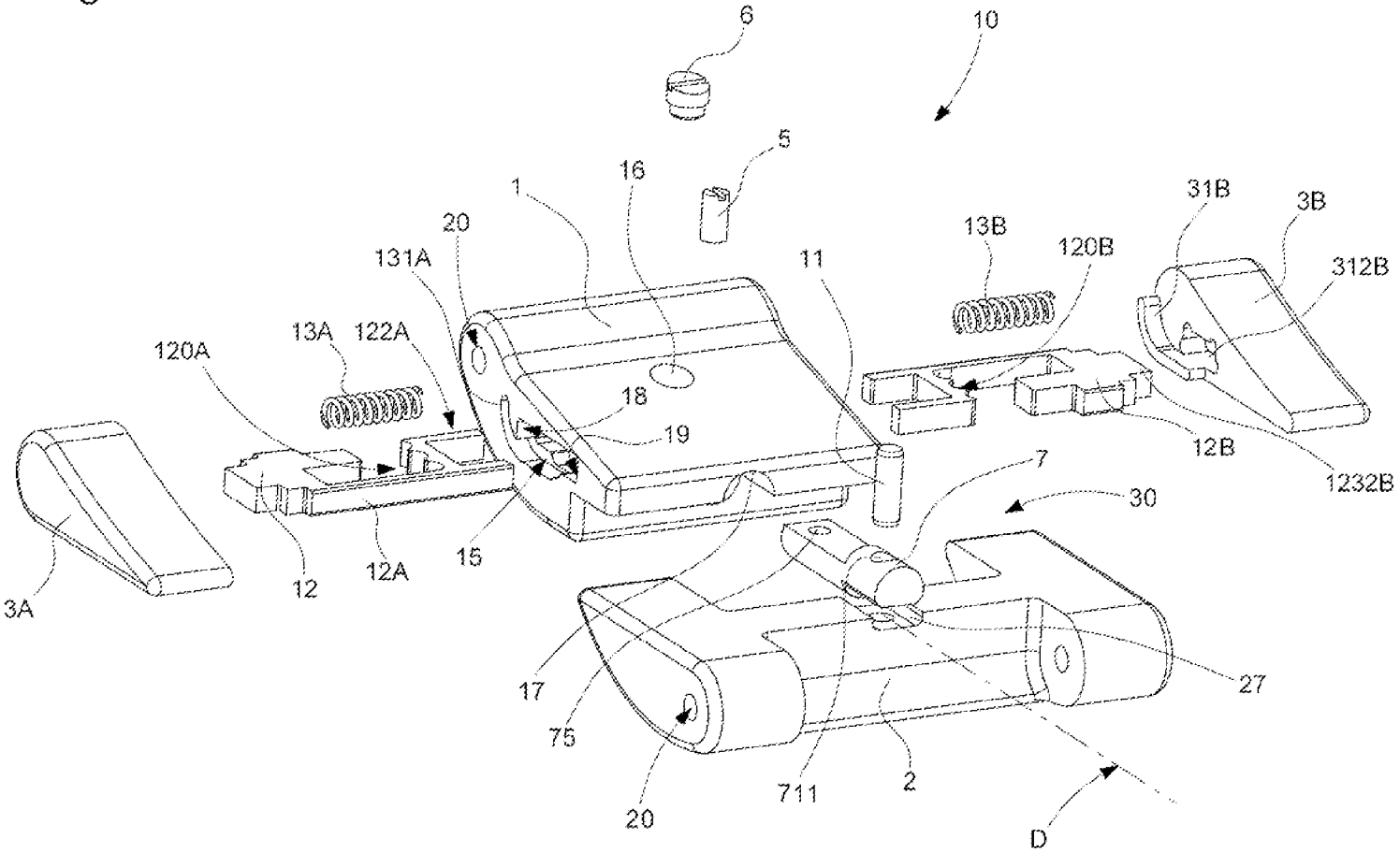
Figure 2:
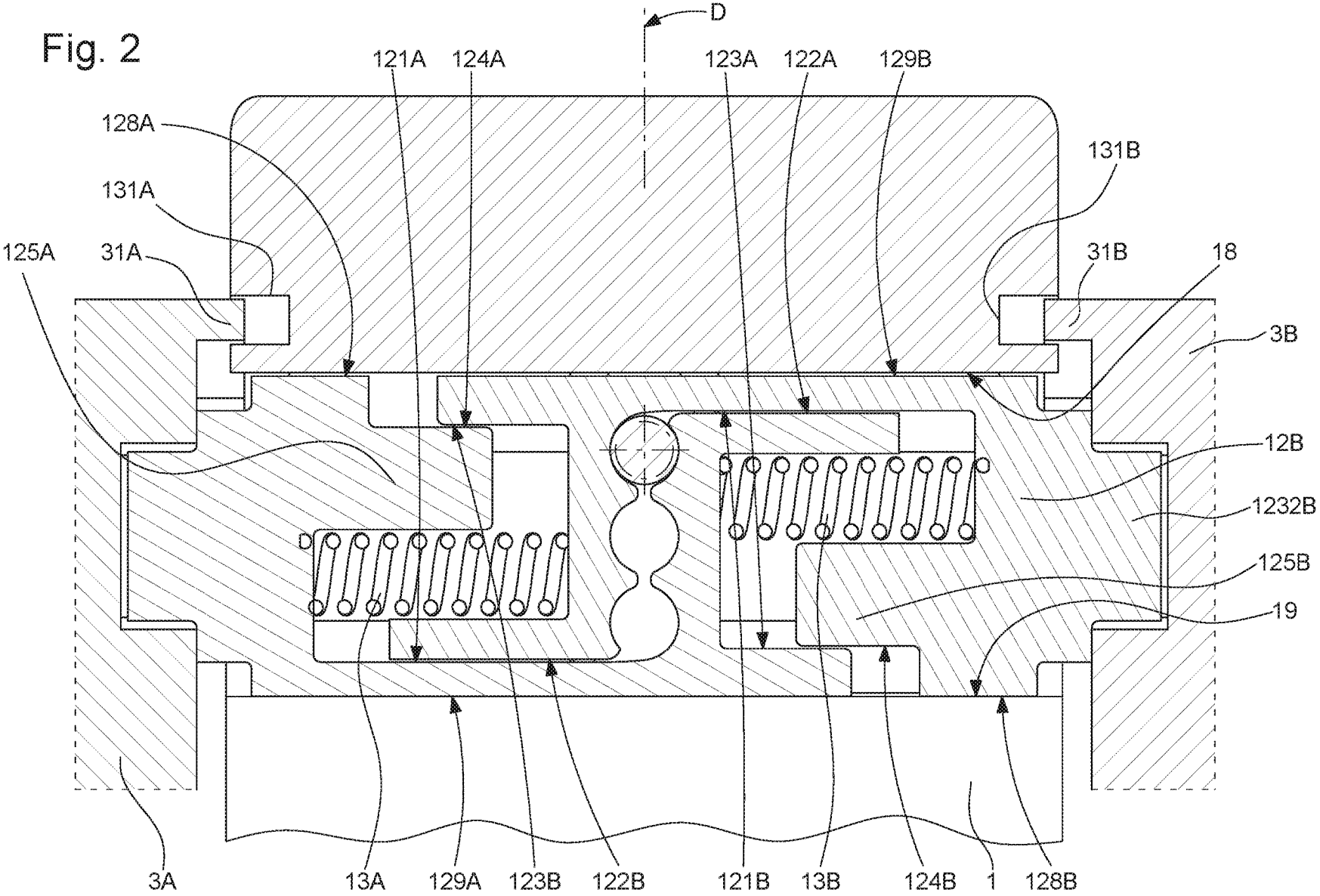
FIG. 2 shows, schematically and in section view along the plane of manoeuvre of the jaws, a portion of the mechanism of FIG. 1, in a minimum longitudinal extension position.
Figure 4:
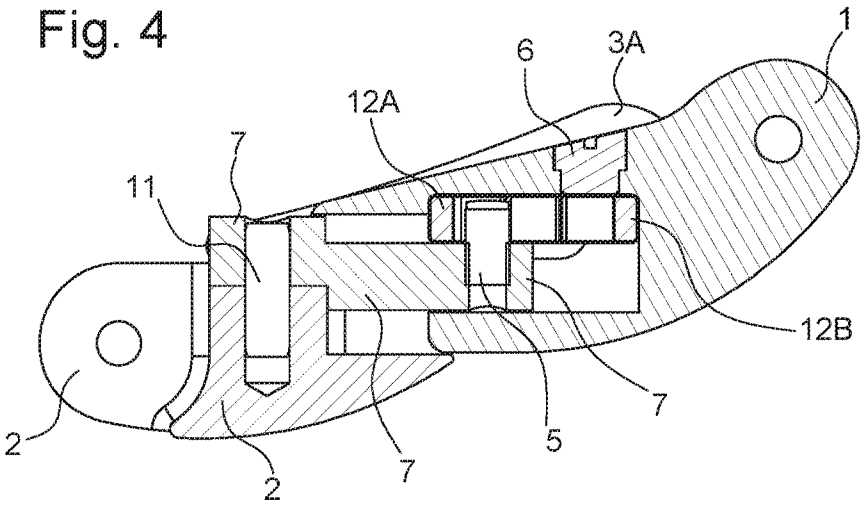
FIG. 4 shows, in a manner similar to FIG. 3, the same adjustable link in a maximum longitudinal extension position.
Figure 6:
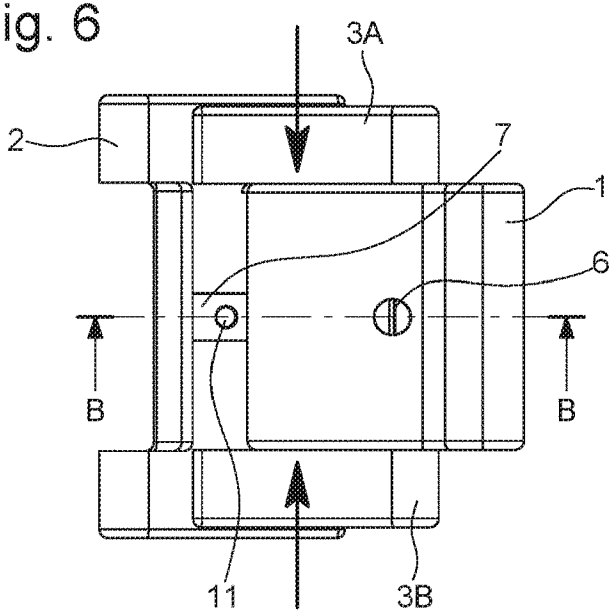
FIG. 6 shows, schematically and in bottom view, the same adjustable link in the position of FIG. 4.
Figure 3:
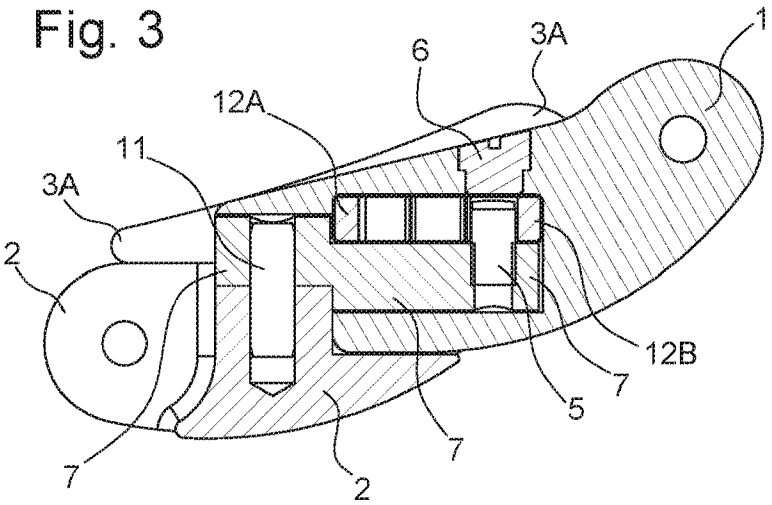
FIG. 3 shows, schematically and in section view along a longitudinal plane perpendicular to same of FIG. 2, the same adjustable link in the same minimum extension position as of FIG. 2.
Figure 5:
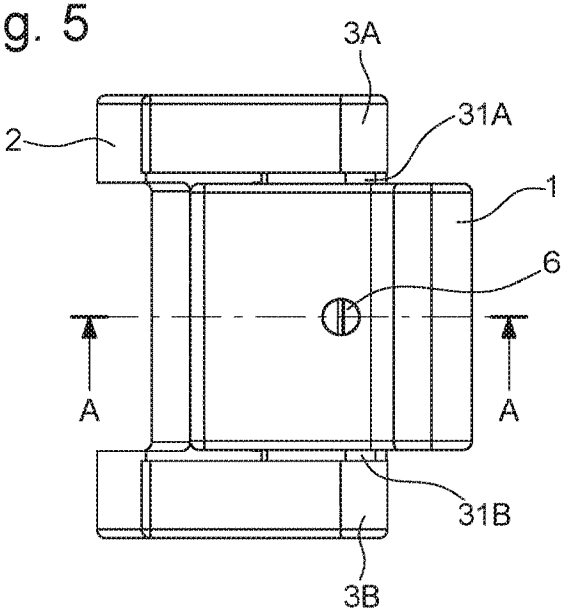
FIG. 5 shows, schematically and in bottom view, the same adjustable link in the position of FIG. 3.
Figure 7:
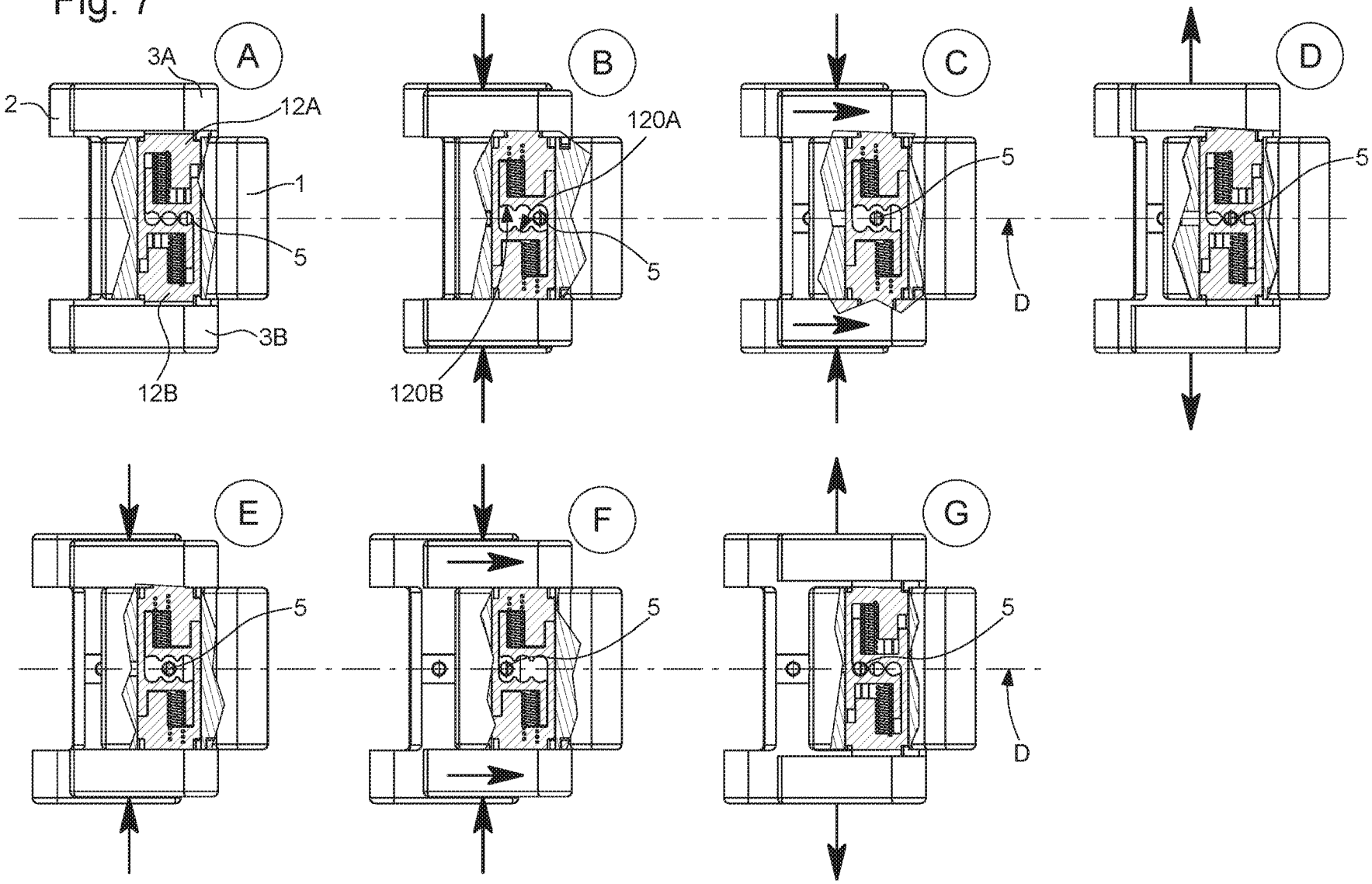
Figure 8:
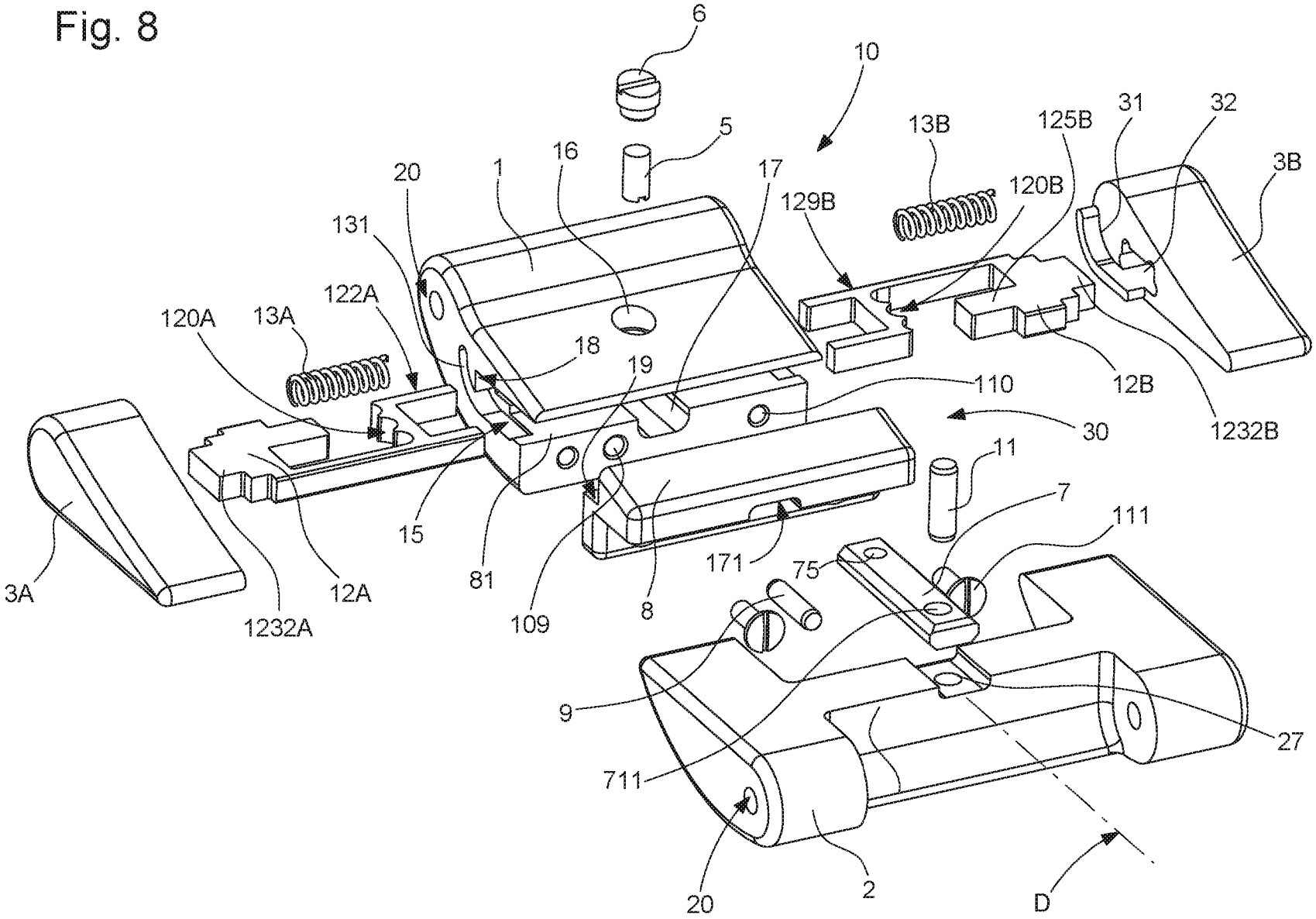
Figure 9:
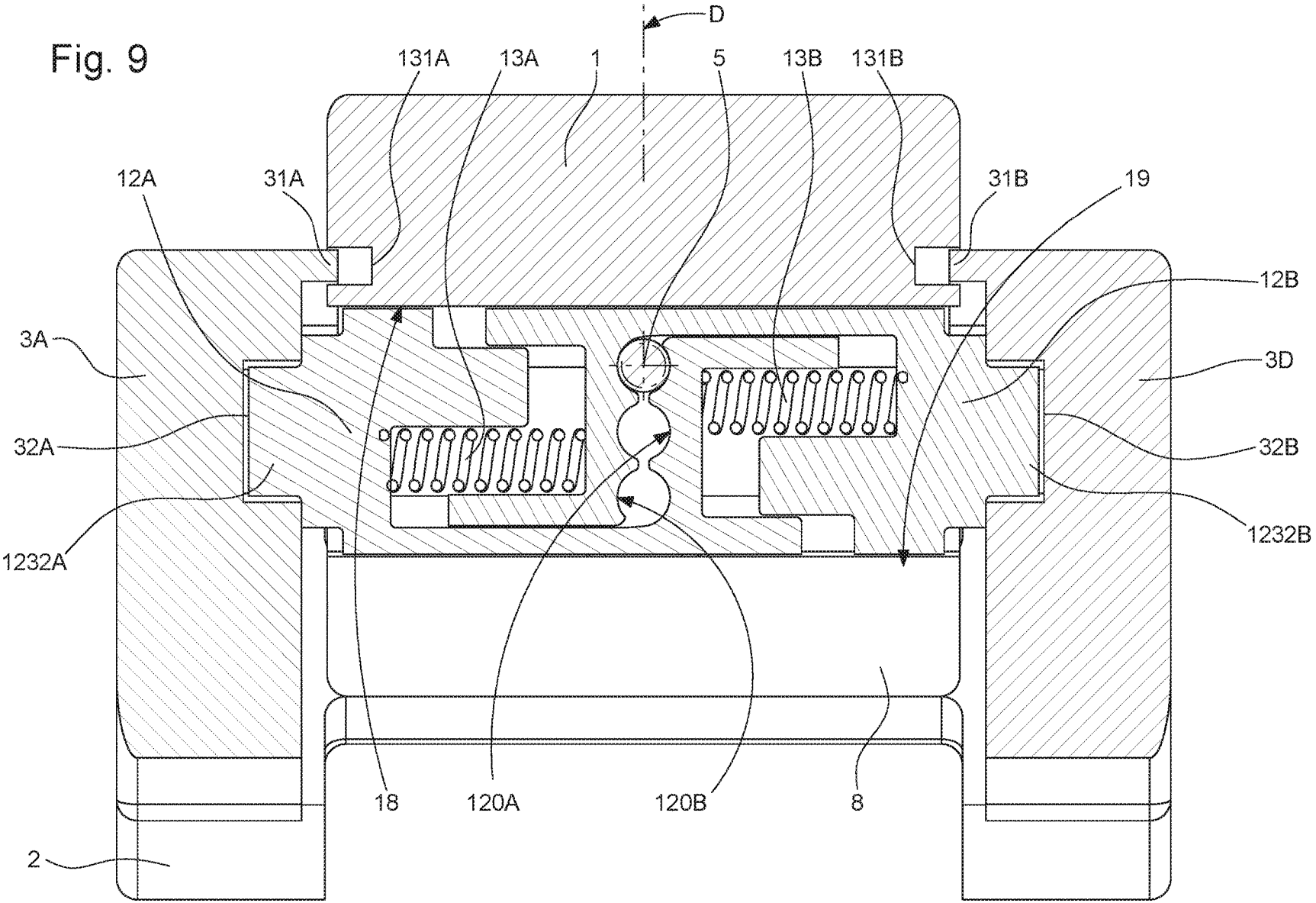
Figure 10:
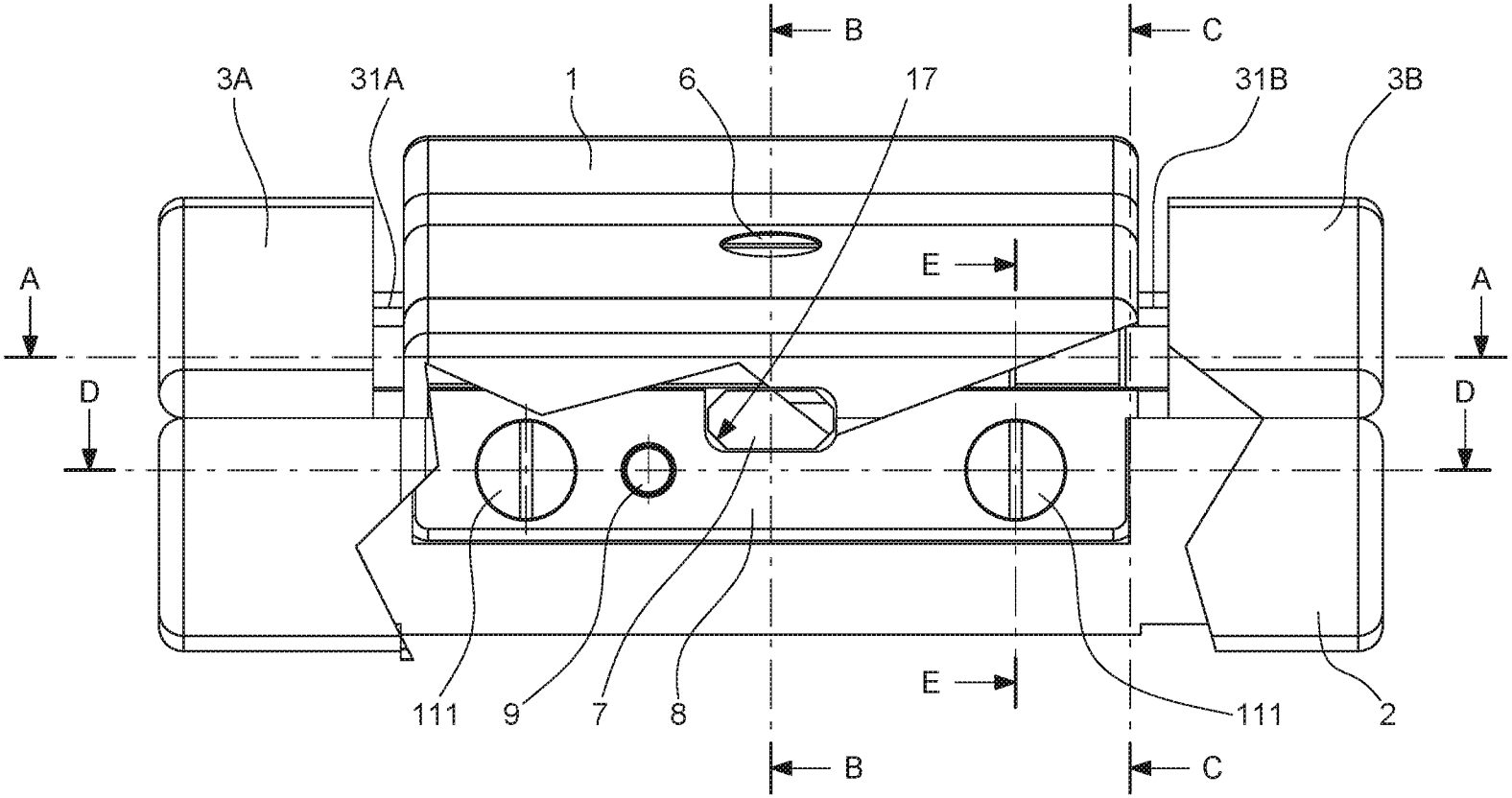
Figure 12:
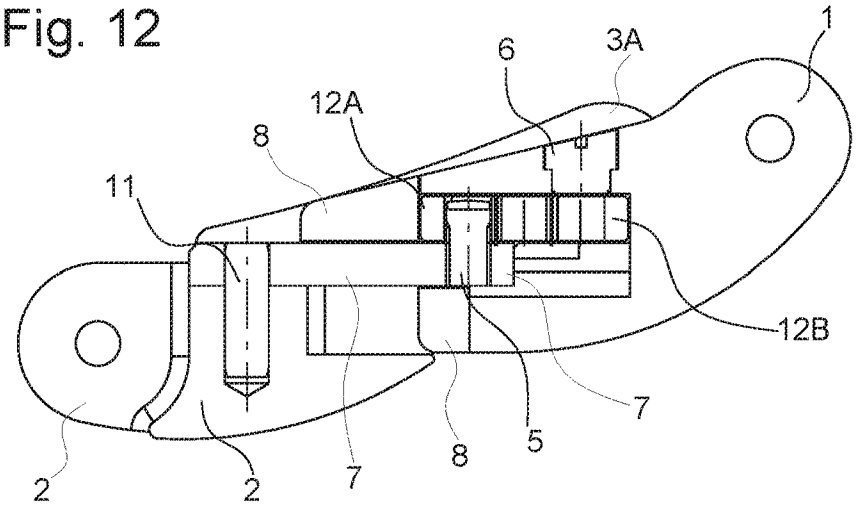
Figure 14:
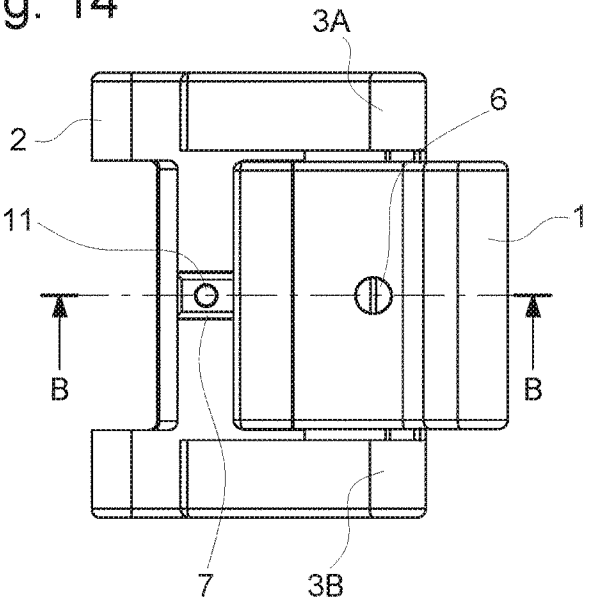
Figure 11:
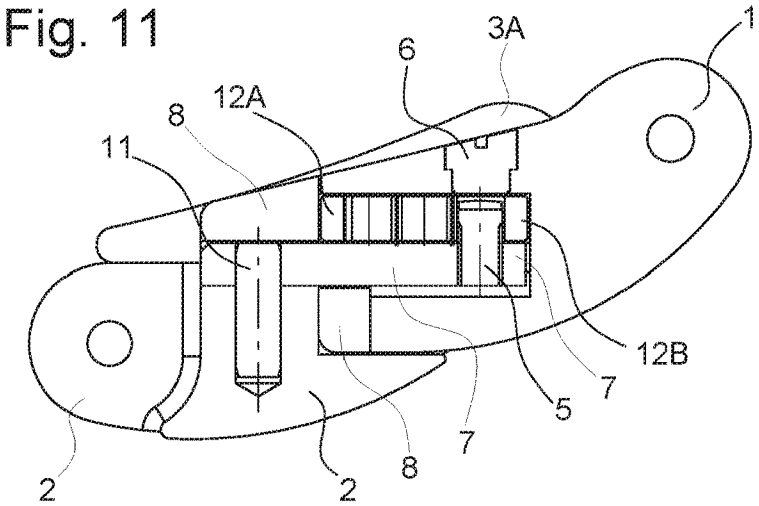
Figure 13:
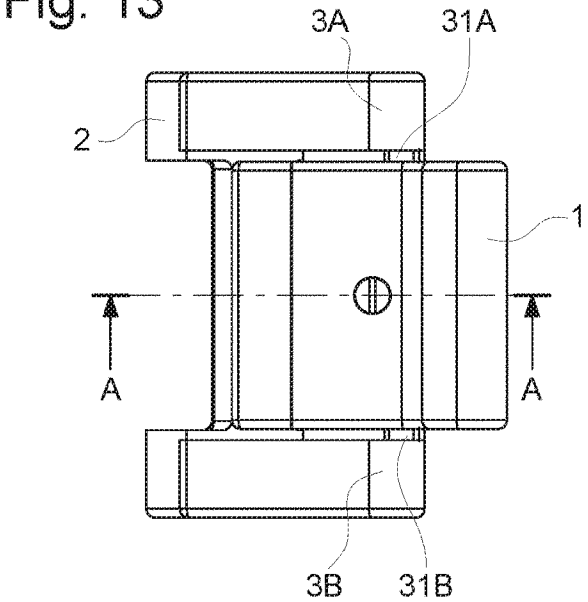
Figure 15:
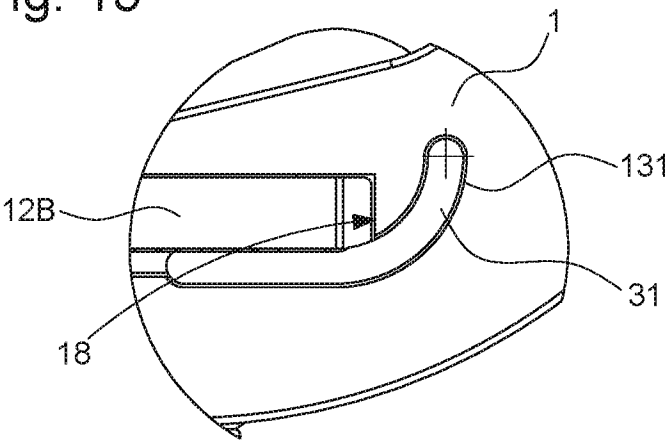
Figure 16:
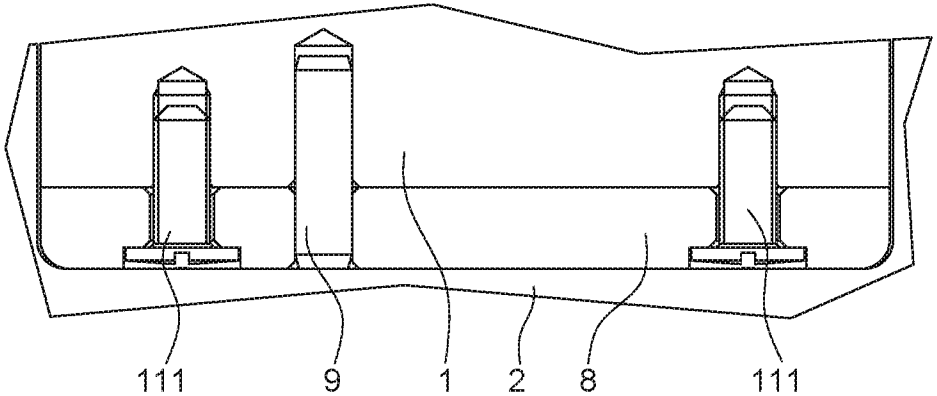
Figure 17:
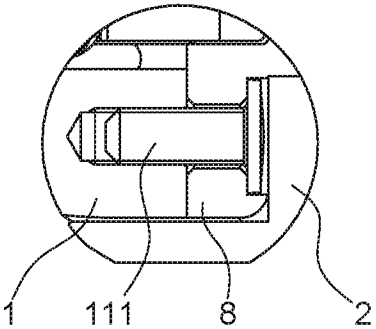
Figure 18:
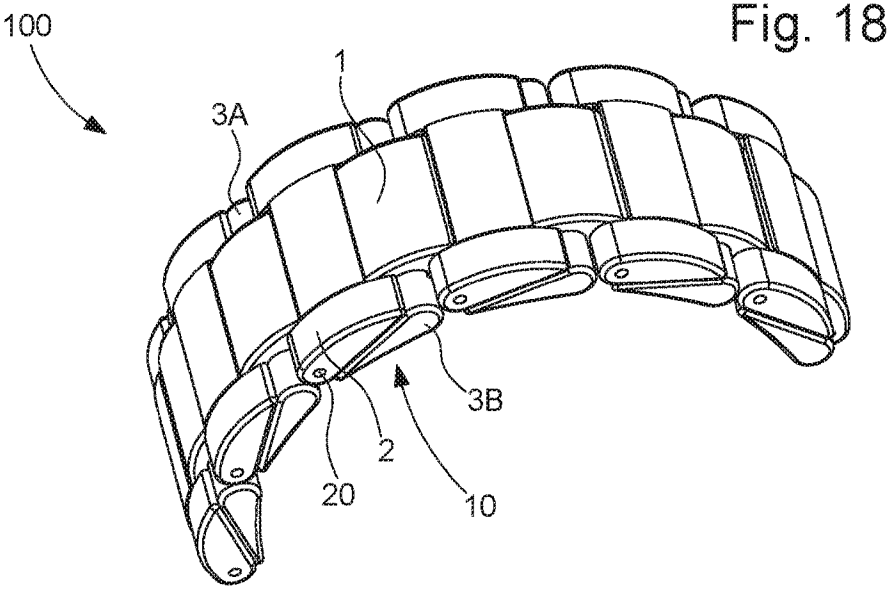
Figure 20:
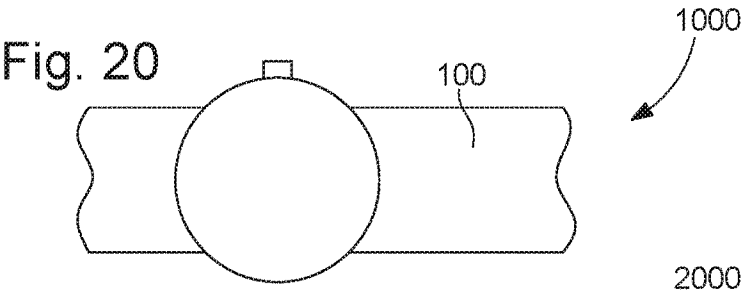
Figure 21:
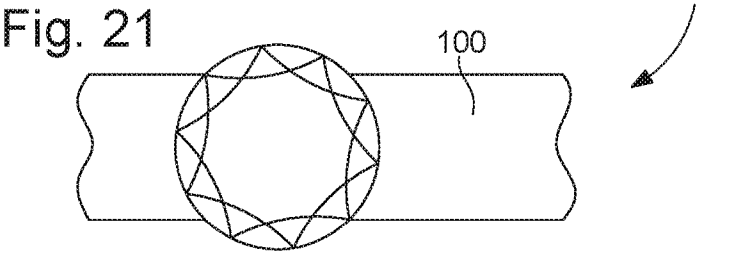
Figure 19:
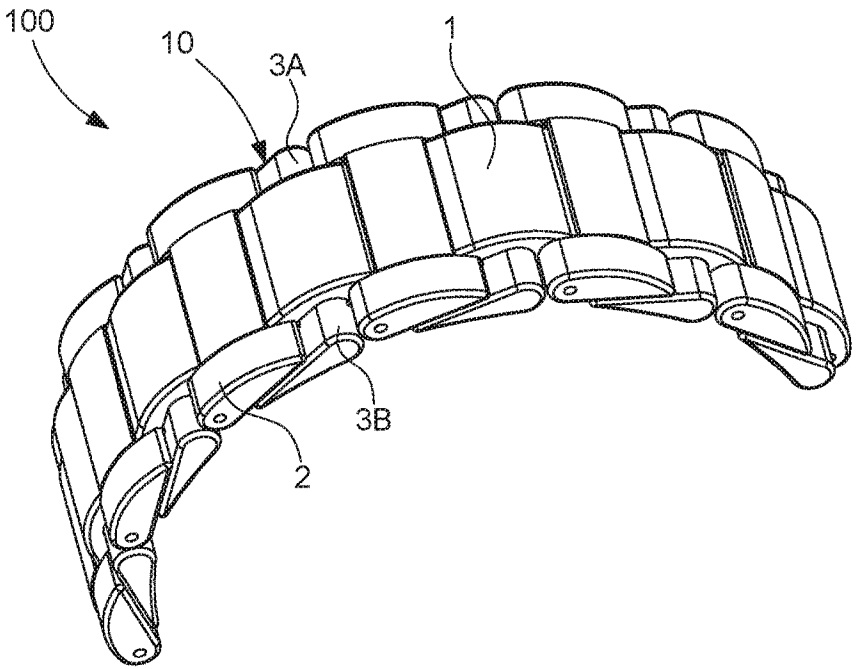

FIG. 7 shows, in seven steps, the kinematics of passage from the position of FIG. 5 in Step A, to same of FIG. 6 in Step G, with intermediate steps of pushing on the push-buttons in Steps B and E, of longitudinal manoeuvre in Steps C and F, and of release of the push-buttons in Steps D and G, Step D corresponding to an average longitudinal extension position, intermediate between the minimum longitudinal extension of Step A and the maximum longitudinal extension of Step G;

FIG. 8 shows, in a manner similar to FIG. 1, a second variant of adjustable link according to the invention, comprising a second portion assembled to the first component for constituting therewith the sliding chamber of the jaws, the first component here being open on one side for enabling the longitudinal insertion of the jaws and of the springs, before enclosing same by fastening said second portion on the first element;

FIG. 9 shows, in a manner similar to FIG. 2, said second variant;

FIG. 10 is a frontal section, perpendicular to both the plane of the jaws and to the longitudinal direction, and showing the interface between the first element and the second element, as well as the guiding of the guiding rod in the first element;

FIGS. 11 to 14 are the pendants, for the second variant, of FIGS. 2 to 6 of the first variant, with the sectional and bottom views of the adjustable link in the minimum and maximum extension positions thereof;

FIG. 15 is a longitudinal section, valid for the first or the second variant, illustrating the complementary engagement between the protrusions or recesses and the complementary protrusions or recesses hiding and protecting the mechanism of the adjustable link;

FIG. 16 is a section along the plane of the jaws of the engagement area, in the second variant, between the first element and the second portion;

FIG. 17 is a longitudinal section of said same area, at a fastening element;

FIG. 18 is a perspective view of a bracelet according to the invention, devoid of clasps, and comprising a plurality of adjustable links all in the minimum longitudinal extension position thereof;

FIG. 19 shows the same bracelet, with a plurality of the adjustable links thereof in a maximum longitudinal extension position;

FIG. 20 shows, schematically and in front view, a wristwatch comprising a bracelet according to the invention;

FIG. 21 shows, schematically and in front view, a piece of jewellery comprising a bracelet according to the invention.

DETAILED DESCRIPTION OF PREFERRED EMBODIMENTS

The invention relates to an adjustable link 10 for a watch or jewellery bracelet 100. Said adjustable link 10 comprises at least one first structural element 1 and one second structural element 2, which are arranged for being assembled with one another in a longitudinal direction D by means of spacing adjustment means 30. The first structural element 1 and a second structural element 2 each comprise, at one of the ends thereof, opposite the spacing adjustment means 30 in the longitudinal direction D, attachment means 20, which are arranged for engaging with complementary attachment means of a watch, or a piece of jewellery, or another link, or a clasp.

Said spacing adjustment means 30 are arranged for a spacing adjustment between the first structural element 1 and the second structural element 2 according to a plurality of discrete positions in the longitudinal direction D.

The first structural element 1 comprises a chamber 15 wherein are moveable, in a transverse direction substantially perpendicular to the longitudinal direction D, two jaws 12A, 12B, which are returned one towards the other by elastic return means, respectively 13A, 13B, and which comprise notches, respectively 120A, 120B. Said notches 120A, 120B, are arranged for immobilising in various positions, in the longitudinal direction D, a stop element 5, notably but not limited to a pin or similar, which is integral with the second structural element 2.

Said jaws 12A, 12B, are disengageable and arranged for being moved apart from one another and for releasing the stop element 5 by two push-buttons, respectively 3A, 3B, which are arranged for being able to be easily pressed simultaneously by a user in the transverse direction.

More specifically, said push-buttons 3A, 3B, each comprise a protrusion or recess 31, continuously engaging in a complementary manner with an complementary protrusion or recess 131, of the first structural element 1, for protecting the spacing adjustment means 30 against the insertion of foreign bodies, and for hiding from the view of the user the spacing adjustment means 30 that are entirely surrounded by the first structural element 1 and the second structural element 2 and the push-buttons 3A, 3B. In the non-limiting example of the figures, the protrusions or recesses, 31A, 31B, that support respectively the push-buttons 3A, 3B, are lips that are inserted into the grooves that constitute the complementary protrusions or recesses 131A, 131B. Naturally, the reverse configuration is possible, with a protrusion integral with the first structural element, engaging with a recess of a push-button.

In one specific variant, not illustrated in the figures, the protrusion or recess 31 or the complementary protrusion or recess 131 constitutes a closed surface entirely surrounding the jaws 12A, 12B, integral with the push-button 3A, 3B, comprising said protrusion or recess 31.

Advantageously, in order to limit the size in thickness of the adjustable link 10, and therefore of the bracelet 100, the jaws 12A, 12B, are interlocked in a coplanar manner, and enclose one with the other the elastic return means 13A, 13B, which consist of, not limited to, springs.

More specifically, the groove 15 comprises a first bearing surface 18 and a second bearing surface 19 opposed arranged for guiding the jaws 12A, 12B, in the transverse direction.

Advantageously, each jaw 12A and 12B comprises a plurality of guiding surfaces, with the first bearing surface 18, the second bearing surface 19, and the other jaw.

Thus, in a specific and non-limiting manner, the first jaw 12A comprises first outer surfaces 128A and 129A arranged for gliding on the first bearing surface 18 and the second bearing surface 19, first intermediate surfaces 124A and 122A for sliding into housings 123B and 121B of the second jaw 12B, and housings 121A and 123A for guiding the second jaw 12B. Said second jaw 12B, mounted top-to-tail with the first jaw 12A comprises, in the same way, first outer surfaces 129B and 128B arranged for gliding on the first bearing surface 18 and the second bearing surface 19, first intermediate surfaces 122B and 124B for sliding into housings 121A and 123A of the first jaw 12A, and housings 121B and 123B for guiding the first jaw 12A.

The figures illustrate two, non-limiting, variants:

on the first variant in FIGS. 1 to 6, the first element 1 is in a single part, and comprises a first bearing surface 18 and a second bearing surface 19; said first variant is advantageous due to the reduced number of components thereof, and it requires a transverse introduction of the two jaws 12A and 12B, and of the two springs 13A and 13B into the chamber 15, before carrying out the fastening of the push-buttons 3A and 3B on the jaws 12A and 12B;

on the second variant in FIGS. 8 to 17, the first element 1 only comprises the first bearing surface 18, and a second portion 8, which is arranged for being fastened on the first element 1, then comprises the second bearing surface 19; the first element 1 and the second portion 8 then delimit together the chamber 15; said second variant makes it easier to assemble the adjustable link 10 in the factory, by allowing an insertion, in the longitudinal direction D, of a pre-mounted subassembly comprising the two push-buttons 3A and 3B supporting the two jaws 12A and 12B, and the two springs 13A and 13B.

More specifically, in said second variant, the first structural element 1 constitutes a first portion comprising the attachment means 20 and the first bearing surface 18, and comprising a frontal groove 81 arranged for enabling an insertion of the jaws 12A, 12B, in the longitudinal direction D, and the second portion 8 comprises the second bearing surface 19 and is arranged for being fastened on the first portion using indexing means 109, such as a bore or similar and complementary indexing means 9 such as a pin or similar, and fastening means 110 such as tappings or similar and complementary tapping means 111 such as screws or similar.

In one specific embodiment, the first structural element 1 comprises an opening 16, which is arranged for allowing the insertion of the stop element 5 between the jaws 12A, 12B, after the mounting thereof in the first element 1, so as to prohibit the transverse removal thereof by said latter, and for receiving a closing element 6 such as a screw or similar, arranged for prohibiting the removal of the stop element 5. Indeed, the notches 120A, 120B, of the jaws 12A, 12B, are arranged one in relation to the other for constituting pliers for immobilising the stop element 5 in a closure position where said notches 120A and 120B are the closest, and wherein no action is applied on the push-buttons 3A and 3B, which are both pushed back towards the outside of the adjustable link 10 by the respective springs 13A and 13B thereof. Advantageously, said opening 16 is positioned on a face intended for coming into contact with the wrist of the user and thus hidden from sight: more specifically, the upper portion, turned upwards in the figures, of the components shown on the perspectives in FIGS. 1 and 8 is, thus, said face intended to be hidden from sight that in general is called the lower surface of the bracelet.

When a user actuates the push-buttons 3A and 3B by pressure from one to the other, same moves apart the notches 120A and 120B, and allows a relative position change between said notches 120A and 120B and the stop element 5, such as visible in FIG. 7, which illustrates position changes of the second component 2 in relation to the first component 1, by actions of pressure of the user on the push-buttons 3A and 3B in Steps B and E, completed, by maintained pressure application, by translational manoeuvres in Steps C and F. Said FIG. 7 illustrates an example with notches 120A and 120B with three slots, the stop element 5 is, in Step A, in a slot the farthest to the right, corresponding to the minimum extension of the adjustable link 10; said manoeuvre in Steps B and C brings the stop element 5 into the middle slot, corresponding to an average extension of the adjustable link 10 in Step D; and the manoeuvre in Steps E and F brings the stop element 5 into the slot to the left, corresponding to a maximum extension of the adjustable link 10 in Step G. The manoeuvre is very simple, is reversible, and makes it possible to voluntarily pass from one extreme position to the other, when the notches 120A and 120B comprise more slots that in the example illustrated.

More specifically, the stop element 5 is a pin, which is arranged for engaging with a first bore 75 of a guiding rod 7 fastened to the second structural element 2; said guiding rod 7 is guided in the longitudinal direction D in a longitudinal groove 17 of the first structural element 1, and is arranged for providing the coplanar holding of the first structural element 1 with the second structural element 2, and for preventing any twisting.

More specifically, the jaws 12A, 12B, comprise distal ends 1232A, 1232B, arranged for being pushed into housings 32A, 32B, that comprise the push-buttons 3A, 3B, and which are arranged for providing the steadfastness of the angular orientation of the push-buttons 3A, 3B, in relation to the jaws 12A, 12B. The reverse arrangement is naturally possible, but more cumbersome.

More specifically, the jaws 12A, 12B comprise distal ends 1232A, 1232B glued or riveted or welded to the push-buttons 3A, 3B, notably in housings 32A, 32B, that comprise the push-buttons 3A, 3B, so as to provide the steadfastness of the angular orientation of the push-buttons 3A, 3B, in relation to the jaws 12A, 12B.

The invention again relates to a watch or jewellery bracelet 100 comprising at least such an adjustable link 10. Advantageously, said bracelet 1000 comprises a plurality of adjustable links 10, so as to benefit from a significant adjustment range, that may reach a plurality of centimetres, which allows the embodiment of a bracelet 100 devoid of a clasp, without any asperity, and with a very pure line. Thus, in one specific version, the bracelet 100 only comprises links, whereof a plurality of such adjustable links 10, and is devoid of a clasp.

FIGS. 18 and 19 show that, advantageously, the second element 2 comprises a flat lower surface, within the immediate vicinity of which is moveable a flat upper surface of the push-button 3A, 3B. Advantageously, said second element 2 comprises, towards the medial portion of the moveable link 10, a first end in pointed shape, opposite to which evolves a first end also in pointed shape of each push-button 3A, 3B, said pointed surfaces cannot injury the user or catch the clothes thereof thanks to said flat surfaces; and the second element 2, as each push-button 3A, 3B, advantageously comprises a second end radiated towards the outside of the adjustable link 10, which guarantees the safety of the user and of the clothes thereof, whilst offering a surface that is easy to manoeuvre with the fingers.

In a more conventional version, not illustrated in the figures, the bracelet 100 comprises an intermediate clasp between a first strand and a second strand that are attached, at the ends thereof opposite the clasp, to a watch or to a piece of jewellery.

More specifically, the first strand and the second strand then each comprise enough adjustable links 10 for enabling the user to position the clasp at equal distance from the ends, regardless of the adjustment made on the clasp when the clasp comprises adjustment means. Said arrangement makes it possible to overcome the discomfort caused, on certain bracelets with wide links, by an off-centred clasp, that may injure the wrist of the user.

The invention again relates to a watch 1000 comprising such a bracelet 100.

The invention again relates to a piece of jewellery 2000 comprising such a bracelet 100.

The invention claimed is:

1. An adjustable link (10) for a watch or jewelry bracelet (100), the adjustable link (10) comprising:

a first structural element (1);

a second structural element (2); and a spacing adjustment mechanism (30) that assembles the first structural element (1) and the second structural element (2) together in a longitudinal direction (D), wherein an end of each of the first structural element (1) and the second structural element (2), away from the spacing adjustment mechanism (30) in the longitudinal direction (D), comprises an attachment means (20) configured to engage with a complementary attachment means of a watch, a piece of jewelry, another link, or a clasp, wherein the spacing adjustment mechanism (30) is configured to provide spacing adjustment between the first structural element (1) and the second structural element (2) according to a plurality of discrete positions in the longitudinal direction (D), wherein the first structural element (1) further comprises a chamber (15), wherein the adjustable link (10) further comprises:

two jaws (12A; 12B) that are moveable, in a transverse direction perpendicular to the longitudinal direction (D), in the chamber (15); the two jaws (12A; 12B) comprising notches (120A; 120B) configured to immobilize a stop element (5) of the spacing adjustment mechanism (30) in various positions in the longitudinal direction (D) such that the spacing adjustment mechanism (30) is provided in the plurality of discrete positions;

elastic return means (13A; 13B) configured to return the two jaws (12A; 12B) towards each other to immobilize the stop element (5); and two push-buttons (3A; 3B) configured to be pressed by a user in the transverse direction, the two push-buttons (3A; 3B) each comprise a protrusion or recess (31) continuously engaging with a complementary protrusion or recess (131) of the first structural element (1) for protecting the spacing adjustment mechanism (30) against insertion of foreign bodies, and for hiding from a view of the user the spacing adjustment mechanism (30) that is entirely surrounded by the first structural element (1), the second structural element (2), and the two push-buttons (3A; 3B), and wherein the two jaws (12A; 12B) are configured to, by the two push buttons (3A; 3B) being simultaneously pressed, move apart from one another such that the spacing adjustment mechanism (30) becomes able to move between the plurality of discrete positions in the longitudinal direction (D) by the stop element (5) being released by the two jaws (12A, 12B).

2. The adjustable link (10) according to claim 1, wherein one from among the protrusion or recess (31) and the complementary protrusion or recess (131) comprises a closed surface that entirely surrounds a portion of the jaws (12A; 12B), and the two jaws (12A; 12B) are connected to the two push-buttons (3A, 3B) that comprise the protrusion or recess (31).

3. The adjustable link (10) according to claim 1, wherein the two jaws (12A; 12B) are interlocked in a coplanar manner, and enclose one another, and the elastic return means (13A; 13B) comprises springs.

4. The adjustable link (10) according to claim 1, further comprising a closing element (6) configured to prohibit removal of the stop element (5) from an opening (16) of the first structural element (1), the opening (16) configured to allow insertion of the stop element (5) between the two jaws (12A; 12B) by receiving the closing element (6).

5. The adjustable link (10) according to claim 4, wherein the stop element (5) is a pin engaged with a first bore (75) of a guiding rod (7) of the spacing adjustment mechanism (30), and the guiding rod (7) is fastened to the second structural element (2), configured to be guided in the longitudinal direction (D) by a longitudinal groove (17) of the first structural element (1), and provides coplanar holding of the first structural element (1) with the second structural element (2).

6. The adjustable link (10) according to claim 1, wherein the two jaws (12A; 12B) comprise distal ends (1232A; 1232B) that are configured to be pushed into housings (32A; 32B) of the two push-buttons (3A; 3B) and fix an angular orientation of the two push-buttons (3A; 3B) in relation to the two jaws (12A; 12B).

7. The adjustable link (10) according to claim 1, wherein the two jaws (12A; 12B) comprise distal ends (1232A; 1232B) that are fixed within housings (32A; 32B) of the two push-buttons (3A; 3B), and are configured to fix an angular orientation of the two push-buttons (3A; 3B) in relation to the two jaws (12A; 12B).

8. The adjustable link (10) according to claim 1, wherein the first structural element (1) further comprises:

a first portion comprising the attachment means (20), a first bearing surface (18) of the chamber (15), and a frontal groove (81) configured to receive the two jaws (12A; 12B) in the longitudinal direction (D); and a second portion (8) comprising a second bearing surface (19) of the chamber (15) and configured to be fastened on the first portion using indexing means (109) and complementary indexing means (9), and fastening means (110) and complementary fastening means (111), wherein the first bearing surface (18) and the second bearing surface (19) of the chamber (15) oppose each other and are configured to guide the two jaws (12A; 12B) in the transverse direction.

9. A watch or jewelry bracelet (100) comprising the adjustable link (10) according to claim 1.

10. The watch or jewelry bracelet (100) according to claim 9, further comprising an intermediate clasp between a first strand and a second strand that are attached, at ends of the first strand and the second strand that are away from the clasp, to a watch or to a piece of jewelry, wherein the first strand and the second strand each comprise enough of the adjustable links (10) for enabling the user to position the clasp at equal distance from the ends, regardless of adjustment made on the clasp by an adjustment means of the clasp.

11. A watch (1000) comprising the watch or jewelry bracelet (100) according to claim 9.

12. A piece of jewelry (2000) comprising the watch or jewelry bracelet (100) according to claim 9.

* * * * *